US007273210B2

(12) United States Patent
Thurston et al.

(10) Patent No.: US 7,273,210 B2
(45) Date of Patent: Sep. 25, 2007

(54) TRUSS ASSEMBLY CLAMP APPARATUS

(76) Inventors: Kenneth Earl Thurston, Rural Route #4, Picton (CA) K0K 2T0; Kathy Marlene Chan, Rural Route #4, Picton (CA) K0K 2T0; Lyle Shayne Anderson, Rural Route #4, Picton (CA) K0K 2T0

( * ) Notice: Subject to any disclaimer, the term of this patent is extended or adjusted under 35 U.S.C. 154(b) by 184 days.

(21) Appl. No.: 10/907,196

(22) Filed: Mar. 24, 2005

(65) Prior Publication Data

US 2005/0210678 A1 Sep. 29, 2005

(30) Foreign Application Priority Data

Mar. 24, 2004 (CA) ..... 2461814

(51) Int. Cl.
*B25B 1/20* (2006.01)

(52) U.S. Cl. ..... 269/37; 269/254 CS; 269/910

(58) Field of Classification Search ..... 269/37, 269/249, 254 CS, 143, 6, 43, 910; 29/281.1
See application file for complete search history.

(56) References Cited

U.S. PATENT DOCUMENTS

| | | | | |
|---|---|---|---|---|
| 2,116,263 | A | 5/1938 | Harbaugh | |
| 2,806,495 | A | 9/1957 | Merkle et al. | |
| 3,172,507 | A | 3/1965 | Blyvels | |
| 3,959,945 | A | 6/1976 | Allen | |
| 4,234,174 | A | 11/1980 | Cardono | |
| 4,253,649 | A | 3/1981 | Hewson | |
| 4,340,100 | A | 7/1982 | Anderson, II | |
| 4,390,172 | A | 6/1983 | Gotman | |
| 4,420,291 | A | 12/1983 | Winstead | |
| 4,704,829 | A | 11/1987 | Baumker, Jr. | |
| 4,958,814 | A | 9/1990 | Johnson | |
| 5,148,890 | A | 9/1992 | Sipe | |
| 5,161,345 | A | 11/1992 | Sobjack, Sr. | |
| 5,407,182 | A | 4/1995 | Hartley | |
| 5,580,036 | A | 12/1996 | Browning | |
| 5,606,837 | A | 3/1997 | Holizlander | |
| 5,785,305 | A * | 7/1998 | Stalker | 269/37 |
| 5,833,359 | A * | 11/1998 | Hollenbach | 362/250 |
| 5,884,411 | A | 3/1999 | Raber | |
| 6,393,794 | B1 | 5/2002 | Pellock | |
| 6,530,565 | B1 * | 3/2003 | Simpson | 269/6 |

(Continued)

FOREIGN PATENT DOCUMENTS

| | | |
|---|---|---|
| CA | 2075636 | 8/1991 |

(Continued)

*Primary Examiner*—Lee D. Wilson
(74) *Attorney, Agent, or Firm*—Simpson & Simpson, PLLC

(57) ABSTRACT

A truss clamp for connection with a second clamp when installing truss assemblies includes a mechanism for adjustably connecting the two clamps in spaced relation. The truss clamp includes a fixed member and a rotatable member, the rotatable member having first and second ends and being pivotally connected to the fixed member intermediate the ends of the rotatable member and being rotatable between a first position wherein the first end is in confronting relation with a portion of the fixed member and a second position wherein the second end is in confronting relation with the portion of the fixed member. A holding mechanism may be disposed over a center spring action mechanism, for selectively maintaining the rotatable member in at least the second position. A method of installing trusses using a truss clamp is also disclosed.

26 Claims, 6 Drawing Sheets

U.S. PATENT DOCUMENTS

| | | | | |
|---|---|---|---|---|
| 6,530,566 | B1 * | 3/2003 | DuVernay | 269/228 |
| 6,658,711 | B1 * | 12/2003 | Benson | 29/237 |
| 7,040,610 | B2 * | 5/2006 | Hubbard | 269/267 |
| 7,066,457 | B2 * | 6/2006 | Gerritsen et al. | 269/6 |

FOREIGN PATENT DOCUMENTS

| | | |
|---|---|---|
| CA | 2168533 | 8/1996 |
| CA | 2215954 | 9/1996 |
| CA | 2284270 | 10/1998 |
| CA | 2286961 | 10/2000 |
| CA | 2364466 | 11/2001 |

* cited by examiner

TRUSS ASSEMBLY CLAMP APPARATUS

FIELD OF THE INVENTION

The present invention relates to a clamping mechanism or device and more particularly to clamping device for use with the installation of trusses for building, particularly roof trusses for peaked roofs of houses and the like.

BACKGROUND OF THE INVENTION

Truss systems are essential for supporting roofs on buildings, and peaked roofs are particularly difficult to put into place by one's self. However, labour costs encourage people to attempt to install truss systems with reduced manpower, perhaps increasing thereby a safety issue.

Canadian Patent File No. 2,364,466, laid open Jun. 3, 2002, of Lin et al., illustrates a truss spacer and brace which provides apparatus for spacing structural members in particular roof trusses, during construction and for permanently bracing the same structural member. The device includes a top truss tab and flanges spaced to define a slot for the truss member.

U.S. Pat. No. 5,884,411 granted Mar. 23, 1999 of Raber discloses a truss alignment apparatus which includes a T-shaped beam member which includes a top planar portion and a bottom planar portion extending perpendicular to the top portion. The bottom planar portion includes a plurality of beam-reception notches positioned longitudinally to it. There is also an alignment level incorporated in the apparatus.

U.S. Pat. No. 5,580,036 granted Dec. 3, 1996 to Browning (see also Canadian Patent File No. 2,215,954) relates to a method and apparatus for remotely securing and spacing trusses and other building frame assemblies. The apparatus is primarily comprised of a spacer having a first truss connector and a second truss connector. A pull down arrangement (example by a rope) is used to remotely engage the apparatus with a truss. In use, the apparatus is attached to a first building member which is then positioned with the apparatus attached. The apparatus is then remotely pulled down and secured to a second, adjacent building member that has just been moved into position.

Although the Browning device potentially permits a reduced number of people to assemble a truss system, it is a somewhat complicated device and requires some means such as a rope to activate the apparatus in order to secure the apparatus to a second adjacent building member. Ropes and the like around construction sites may be hazardous at times.

It would be desirable to provide a more simple and economical clamp apparatus which is operative essentially automatically once attached to a first building member to capture and temporarily secure a second adjacent building member or truss swung into place, until the second member can be finally secured with appropriate spacer members and the like.

SUMMARY OF THE INVENTION

The present invention in one aspect relates to a truss clamp device and more particularly in one aspect to a truss clamp for connection with a second clamp, wherein the truss clamp comprises means for adjustable connection with the second clamp and has a fixed member to which a rotatable member, having first and second ends, is pivotally connected intermediate the ends thereof. The rotatable member is rotatable between a first position wherein the first end is in confronting relation with a portion of the fixed member and a second position wherein the second end is in confronting relation with the portion of the fixed member. The rotatable member is selectively maintained in at least the second position and preferably in both positions. A spring mechanism in co-operation with the fixed member and the rotatable member maintains the rotatable member in both positions by an "over center" configuration relative to the pivot connection.

Preferably, the device includes a releasable lock mechanism to lock the rotatable member in the second position and the rotatable member is configured to maintain the lock mechanism out of lock position when it is in the first position and to automatically release the lock mechanism when it moves to the second position. A stop mechanism on the rotatable member cooperates with the fixed member to limit rotation of the rotatable member in the second position under the bias of the spring means.

The invention also provides a truss clamp assembly comprising a first clamp and a second clamp, the first and second clamps each having bar means adjustably connected whereby spacing between the clamps may be selectively adjusted. The first clamp has releasable clamp means adapted to be clamped to a fixed truss and the second clamp has a fixed member and a rotatable member, the rotatable member having first and second ends. The rotatable member is pivotally connected to the fixed member intermediate the ends of the rotatable member and is rotatable between a first position wherein the first end is in confronting relation with a portion of the fixed member and a second position wherein the second end is in confronting relation with the portion of the fixed member. Means selectively maintain the rotatable member in the first position and the second position, the maintaining means comprising spring means configured in relation to the pivotal connection to provide an over center action to selectively maintain the member in the first position or second position. An auxiliary clamp is provided for adjustable connection with one of the bar means and is adapted to be temporarily connected to a truss intermediate trusses to which the first and second clamps are associated in use of the clamp assembly.

The invention further comprises a method of installing a second truss in constructing a roof structure, wherein at least one first truss is already secured in place, each truss having a base and peak roof portion, the method including the steps of:

providing a truss clamp comprising a first clamp, a second clamp, and means adjustably connecting the clamps in spaced relation, the spacing between the clamps being selected in accordance with desired spacing between the trusses when installed, the second clamp including a trip clamp mechanism;

detachably connecting the first clamp to a part of the peak roof portion of the secured first truss such that the second clamp extends in a direction where the second truss is to be located;

locating the base of the second truss generally parallel with the base of the first secured truss and moving the peak roof portion of the second truss into a position whereby the second truss peak roof portion engages with and trips the trip clamp mechanism of the second clamp so that the peak roof portion of the second truss is releasably held in position by the second clamp; and, permanently securing the second truss in place by other means and removing the truss clamp for selected reuse.

Other aspects and features of the invention will become evident from reviewing the detailed description of preferred embodiments in conjunction with the drawings, as set forth herein.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments.

Figure 1:
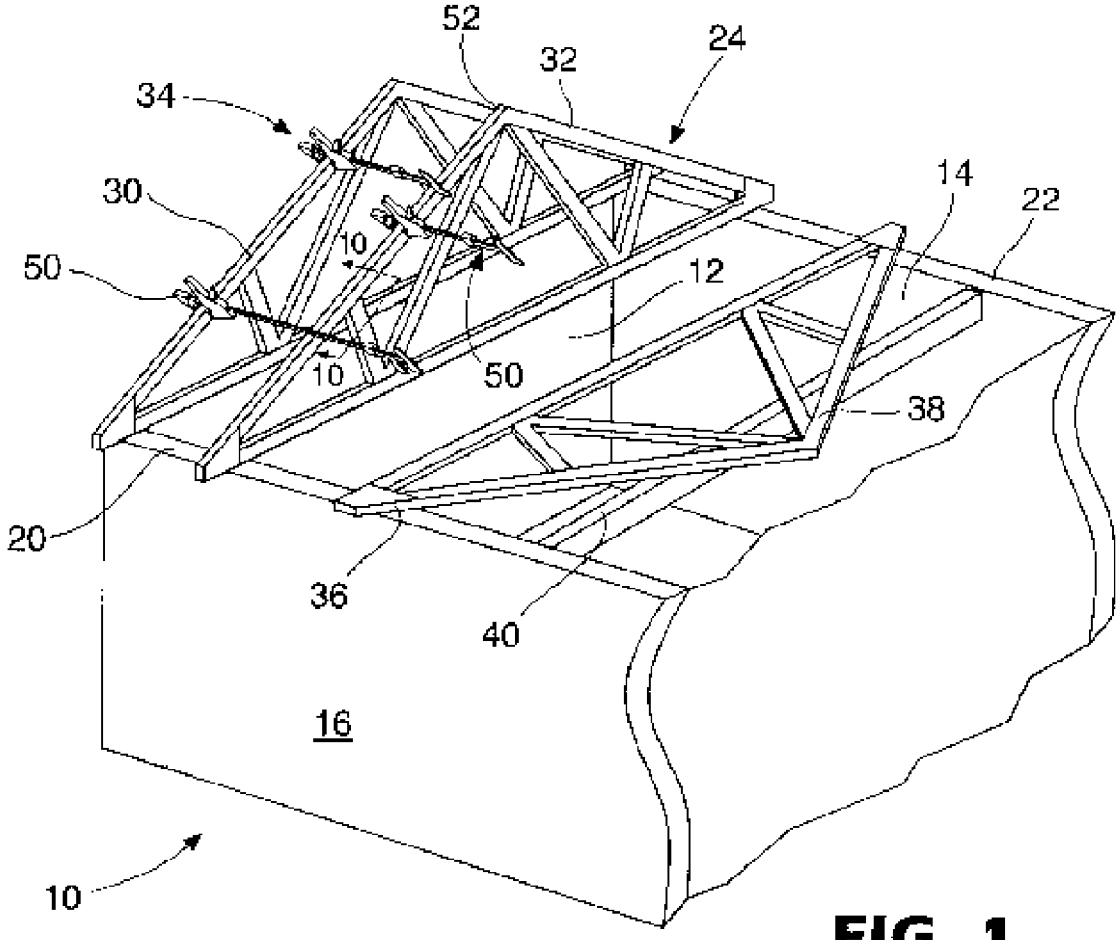
FIG. 1 is a schematic view of a roof truss assembly wherein two trusses are in secured position and a third is readied for being swung into place.

Turning to the drawings, FIG. 1 schematically illustrates a section of a building 10 having walls 12, 14 and 16 with walls 12, 14 having at least upper surfaces 20, 22 respectively to which trusses of assembly 24 are secured. Illustrated are first and second trusses 30, 32 secured to the surfaces 20, 22 and showing a brace 34 between the first truss 30 and second truss 32. It will be appreciated by those skilled in the art that additional braces between the trusses 30, 32 could be used. A third truss 36 is shown having ends lying on surfaces 20, 22 and with the central section 38 of truss 36 supported by a cross beam 40 or the like, whether such beam 40 is temporary or permanently secured to walls 14 and 16. Other wall support members can be present, but have been omitted for the sake of simplicity.

With truss 32 (as well as truss 30) secured in position, and appropriately braced, at least one clamp device 50 in accordance with the invention is secured at one end thereof to the truss 32 adjacent the top thereof as shown in FIG. 1. Preferably at least one second like clamp device 50 (not shown) would be installed on the other side of peak 52 of truss 32. Clamp device 50 is more particularly shown in FIGS. 2-5.

Figure 2:
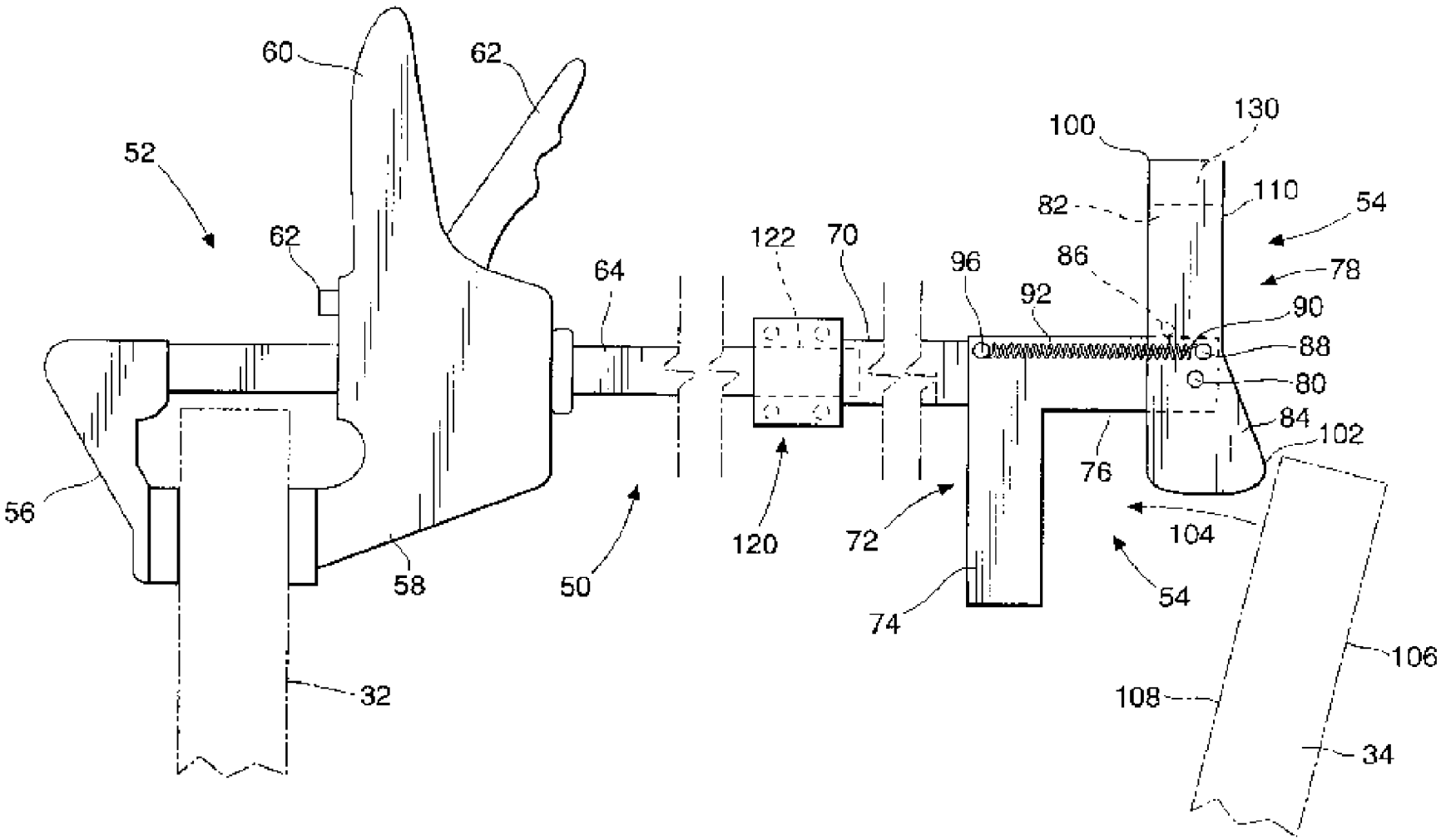
FIG. 2 is a side view of a preferred embodiment of the clamp apparatus according to the invention with a first portion of the clamp device, clamped to an already secured truss while the next adjacent truss to be secured is being swung into place toward a second portion of the clamp devices.

In FIG. 2, clamp device 50 is shown to include an adjustable, first clamp section 52 and a second, pivotal clamp section 54. First clamp section 52 is basically a known form of a bar clamp device and has fixed jaw 56 and slidable jaw 58 with fixed handle portion 60 and squeezeable handle portion 62. First clamp section 52, as a bar clamp, operates in known fashion and release button 64 allows the jaws 56, 58 to separate, the jaw 58 sliding on bar 64 relative to jaw 56. In use, first clamp section 52 is secured to truss 32.

As further shown in FIG. 2, second clamp section 54 includes bar 70 and has L-shaped clamp member 72 welded or otherwise secured to bar 70. L-shaped clamp member 72 comprises leg portion 74 and arm portion 76. Spaced from leg portion 74 is rotatable clamp member 78 which is pivotally secured to arm portion 76 at pivot 80. Rotatable clamp member 78 has opposite side surfaces 82, 84 and has pins or posts 86 and 88 extending from opposite side surfaces 82 and 84 respectively. Pin or post 86 on the far side surface 82, as seen in FIG. 2 acts as a stop means relative to arm portion 76 to limit the rotation of rotatable clamp member 78 in the counterclockwise direction as shown in FIG. 2. Pin or post 88 on the near side surface 84 extends outwardly so as to enable securement of one end of coil spring 92. The other end of coil spring 92 is secured to another pin or post 96 secured to L-shaped clamp member 72.

Pivotal clamp member 78 is configured to have a straight section 100 and a bulbous section 102.

Figure 4:
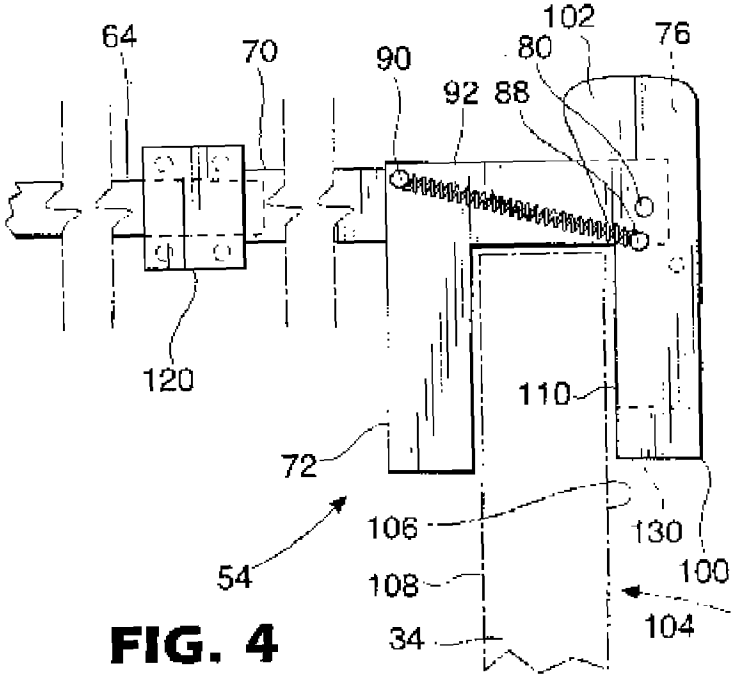
FIG. 4 is a side view of part of the clamp device of FIG. 2 showing the adjacent truss temporarily secured into place with the clamp device.
Figure 3:
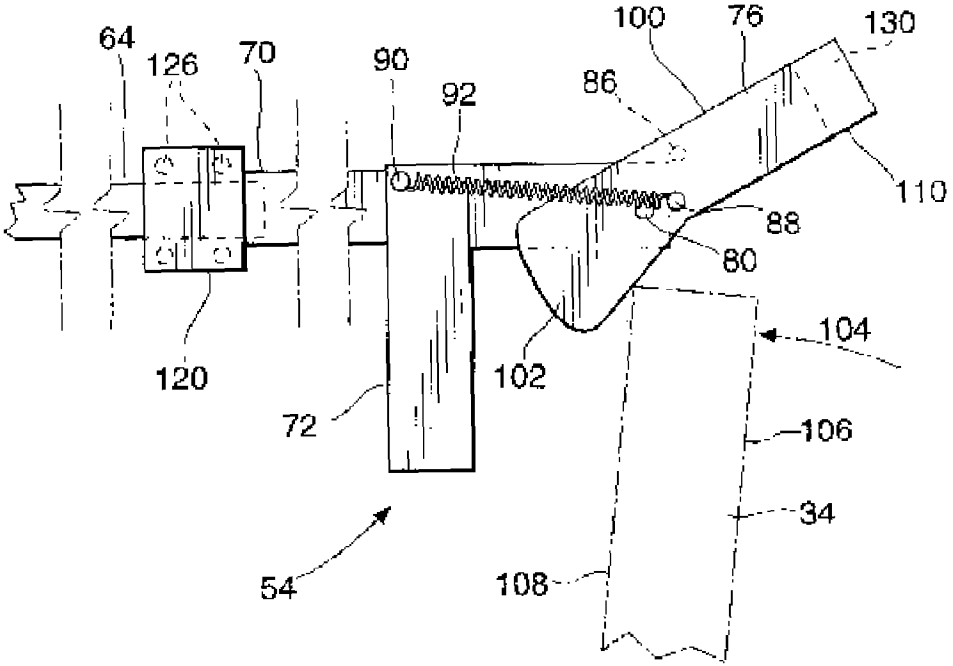
FIG. 3 is a side view of part of the clamp device of FIG. 2 showing further movement of the adjacent truss into place for securement.

It will be appreciated from reviewing FIGS. 2-4 that as truss 34 shown in dotted lines is swung into place in the direction of arrow 104, its upper end 106 contacting bulbous section 102 of clamp member 78. Continued forced movement of upper truss end 106 in the direction of the arrow 104 forces and causes clamp member 78 to rotate in a clockwise direction as seen in FIG. 3. Continued movement of truss 34 causes truss side 108 to contact clamp leg portion 74 at which time rotatable clamp member 78 has rotated so that flat edge 110 contacts the side of upper end 106 of truss 34. During the rotation of rotatable clamp member 78, coil spring 92 has moved over pivot 80, that is, an "over center" action is provided by the configuration of the spring 92 and pivot 80 when member 78 is rotated. Rotatable clamp member edge 110 is thus caused to contact and hold the upper portion 106 of truss 34 tightly against fixed clamp member 72 under the bias of spring 92. In summary, the rotatable clamp member 78 with the over center spring/pivot configuration, is caused to trip from a first non-clamping position to a second clamping position.

Figure 5:
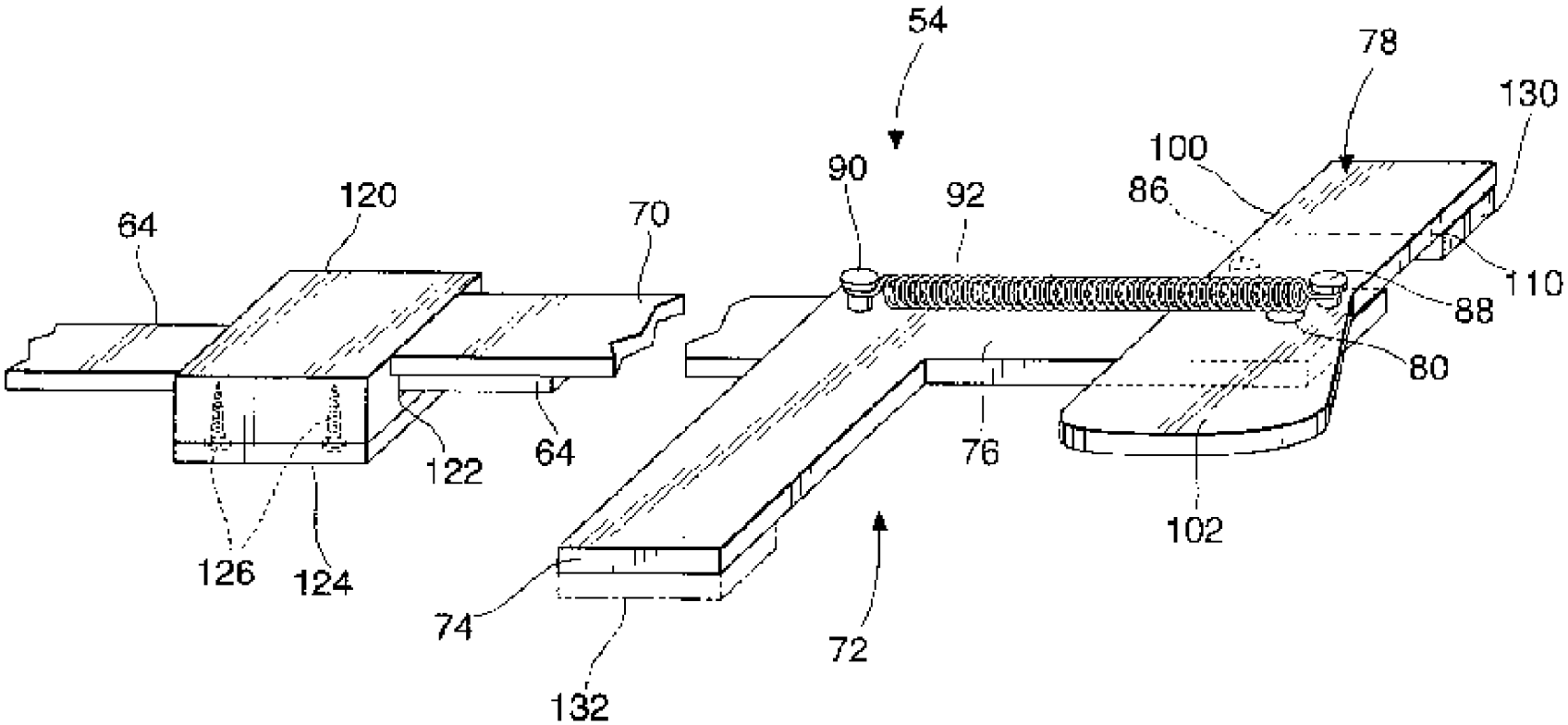
FIG. 5 is a side perspective view from the top of the clamp device of FIGS. 3 and 4 in its ready position as shown in FIG. 2.

Clamp sections 52 and 54 are adjustably associated via block 120 which is secured to bar 70, such as by welding. Block 120 has means provided in the illustrated embodiment, as best seen in FIG. 5, to secure bar 64 thereto, such means comprising a groove 122 in block 120 and cover plate 124 secured by fastening screws 126. FIG. 5 is a perspective view from the bottom of the clamp section 54 as seen in FIG. 2. This construction allows relative movement between the bars 64, 70 when screws 126 are loosened. Accordingly, the spacing between the first clamp section 52 and the second clamp section 54 can be adjusted to match the desired spacing between adjacent trusses.

When truss 34 is clamped in place, it is then secured by normal bracing (not shown) and clamp device 50 can be removed by releasing clamp section 52 from truss 32 and pulling both sections 52 and 54 upwardly from trusses 32 and 34 respectfully. Clamp device 50 is then reused for the next truss to be swung into place (not shown), clamp section 52 being then clamped to the just installed truss 34.

As shown in dotted lines in FIGS. 2, 3 and 4, and full lines in FIG. 5, pivoted clamp portion has block 130 which enlarges the contact area between the edge 110 of rotatable clamp member 78 and the side of truss upper end 106. A similar block 132 (FIG. 5) can be made part of member 74 for similar reasons.

It will be appreciated that any number of clamp devices or apparatuses 50 can be used and reused in erecting a truss assembly. If final securement of a truss by normal means is not performed until several trusses have been located in place, then the clamp device 50 can be left in place until final securement is made. The spring force of spring 92 is made such as to firmly hold and temporarily secure each truss swung into place. Nevertheless, the clamp section 54 may be easily pulled from a truss 34 swung into place and otherwise normally secured.

Turning to FIGS. 6 to 9, a further preferred embodiment of the invention and more particularly, pivotal clamp section 54*a* is illustrated. Parts which are essentially the same to the embodiment of FIGS. 2 to 5 have the same reference numerals and other parts or elements which have been modified, but are similar, are designated with an "a".

Figure 8:
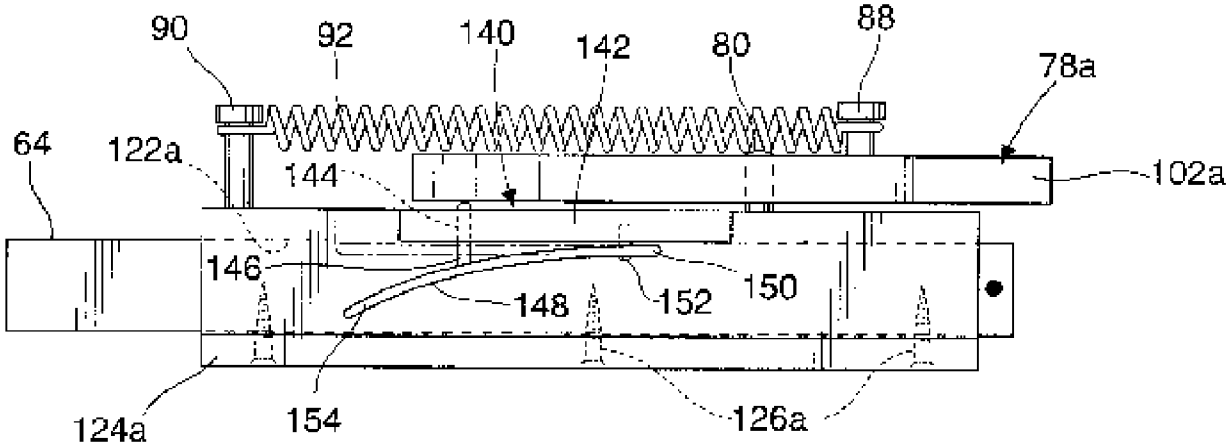
FIG. 8 is a side view of the clamp section of FIG. 6 looking in the direction of arrow 8 of FIG. 6.
Figure 9:
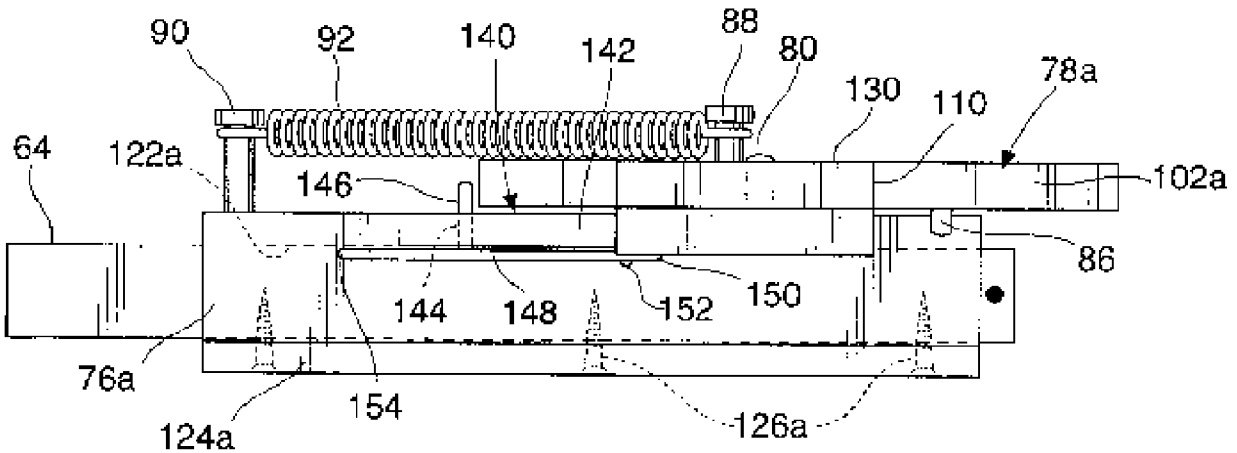
FIG. 9 is a side view of the clamping section of FIG. 7 looking in the direction of arrow 9 of FIG. 7.

As seen in FIGS. 8 and 9, arm portion 76*a* of L-shaped clamp member 72*a* is sized and configured to have groove 122*a* therethrough, groove 122*a* configured to accept bar 64 of clamp section 52. Arm portion 76*a* has cover plate 124*a* which is detachable and releasably secured to arm member 76*a* by screw fasteners 126*a*, or the like. The construction incorporates the adjustability between clamp sections 52 and 54*a* into the arm portion 76*a* of the L-shaped clamp member 74.

Figure 7:
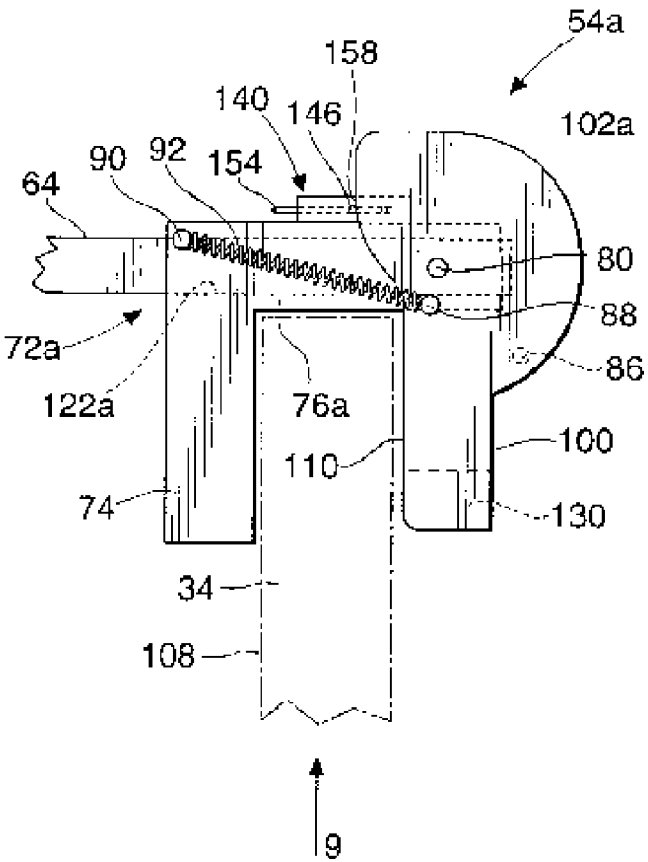
FIG. 7 is a view similar to FIG. 3, of the embodiment of FIG. 6, with the clamp section tripped and holding a truss.
Figure 6:
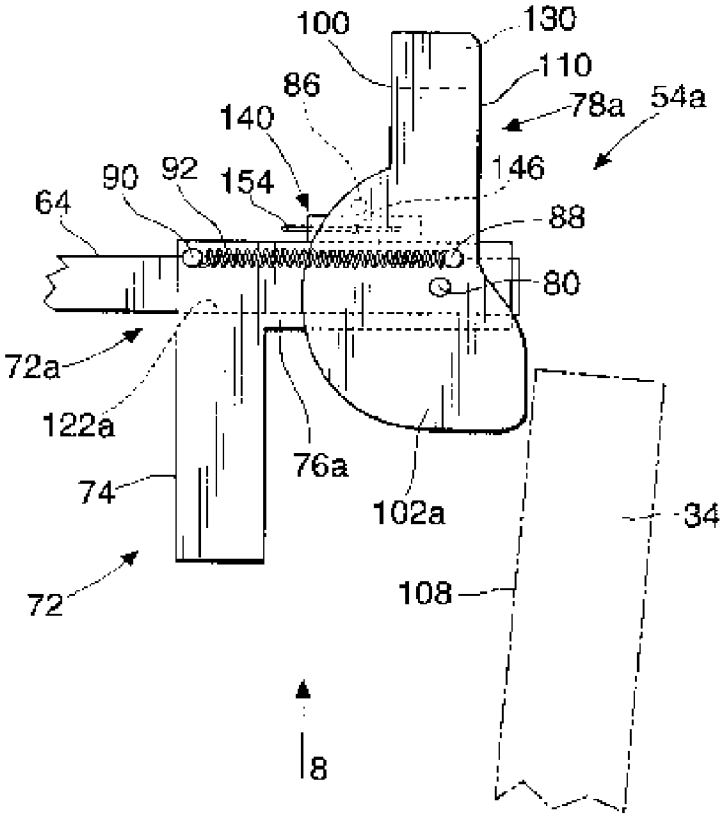
FIG. 6 is a side view similar to FIG. 2 of another, more preferred, embodiment of the invention with the clamp section in a set position for being tripped.

Turning to FIGS. 6 and 7, the main difference between this embodiment and that of FIGS. 2 to 5 is in the enlarged bulbous portion 102*a* which is generally semi-circular. Further, there is a lock mechanism 140 which locks the rotatable clamp member 78*a* from accidentally opening while other forms of securement of the truss are being effected. Lock mechanism 140 comprises block or housing 142 which is secured to and effectively part of arm portion 76*a*. Block 142 has a through bore 144 within which pin 146 reciprocates. Pin 146 is secured to spring arm 148 and spring arm 148 is secured at one end 150 to block 142 by fastener means 152. The other end 154 of spring arm 148 extends beyond the block 142 and can be manually activated or manipulated.

As will be appreciated from FIGS. 6 and 8, when pivotal section 54*a* is in position to be tripped by a truss 34, the bulbous portion 102*a* covers and maintains pin in a retracted position (FIG. 8) whereas when truss 34 has tripped rotatable clamp member 78*a*, the bias of spring arm 148 forces pin 146 to extend outwardly so that pin 146, in contacting part 158 of bulbous portion 102*a*, prevents rotatable clamp member 78*a* from rotating back in a counterclockwise direction as seen in FIG. 7.

Arm spring end 154 can be manually manipulated (downwardly as seen in FIGS. 8 and 9) to retract pin 142 and allow the rotatable clamp member to be returned to the position shown in FIG. 6.

The clamp device 50 has clamp sections 52 and 54 (54*a*) spacially adjustable relative to each other to enable the distance between them to be selected. Although two or any number of clamp devices 50 can be used in assembling trusses of a building, additional support during assembly can be provided and, the invention further comprehends a clamp device 50 wherein the selected space between clamp sections 52 and 54 (54*a*) is twice the desired spacing between adjacent trusses. In this embodiment there is preferably and adjustable auxiliary clamp element 160 shown in FIG. 10.

Figure 10:
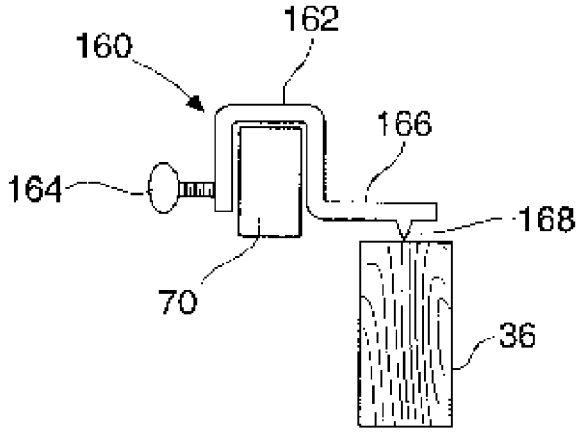
FIG. 10 is a cross sectional view of a truss and the bar of a bar clamp illustrating an adjustable auxiliary clamp device when the inventive clamp device is configured to span or extend over an already secured truss.

FIG. 10 is a cross-sectional view of the bar 64 of clamp section 52 and of a truss 34. Auxiliary clamp element 160 has a U-shaped portion 162 with thumb screw 164 so that device 160 can be slidably fixed or secured to bar 64 at a desired location. Auxiliary clamp element 160 has extension 166 with a prong or projection 168. In use, clamp section 52 with an extended bar 64 can be secured to fixed truss 30 for example, and auxiliary clamp element 160 adjusted so that projection 168 is aligned with fixed truss 32 and clamp section 54 (54*a*) is in place to secure truss 36 when it is swung up into position. Prong or projection 168 is tapped by a hammer into the upper frame member of the intermediate truss which further steadies the clamp device 50 when the next adjacent truss 36 is swung into position. The added stability to the clamp device 50 with the increased span and auxiliary clamp element 160 is significant. Such an extended version of the clamp device is shown in dotted lines in FIG. 1 as 50' although it would normally in use be higher up and closer to the ridge section of the truss.

Although applicants have described preferred embodiments of the invention, variations and modifications will be apparent to those skilled in the art and applicants do not limit the scope of the invention solely to such preferred embodiments, but include variations and modifications which fall within the scope of the appended claims.

What is claimed is:

1. A truss clamp for connection with a second clamp, said truss clamp comprising:

means for adjustable connection with said second clamp;

a fixed member and a rotatable member, said rotatable member having first and second ends, said rotatable member being pivotally connected to said fixed member intermediate the ends of said rotatable member and being rotatable between a first position wherein the first end is in confronting relation with a portion of said fixed member and a second position wherein the second end is in confronting relation with said portion of said fixed member; and means for selectively maintaining said rotatable member in at least said second position, wherein said means for selectively maintaining said rotatable member in said second position comprises spring means.

2. The truss clamp of claim 1 including means for selectively maintaining said rotatable member in said first position.

3. The truss clamp of claim 2 wherein said means for selectively maintaining said rotatable member in said first position comprises spring means.

4. The truss clamp of claim 3 further including a releasable lock mechanism to lock said rotatable member in said second position.

5. The truss clamp of claim 3 further including stop means on said rotatable member which cooperates with said fixed member to limit rotation of said rotatable member in said second position under the bias of said spring means.

6. The truss clamp of claim 2 wherein said means for selectively maintaining said rotatable member in said first and second positions is spring means connected between securement means on said fixed member and securement means on said rotatable member, said securement means and spring means configured such that said spring means goes over center relative to said pivotal connection when said rotatable member rotates between the first position and the second position.

7. The truss clamp of claim 6 further including a releasable lock mechanism to lock said rotatable member in said second position.

8. The truss clamp of claim 6 further including stop means on said rotatable member which cooperates with said fixed member to limit rotation of said rotatable member in said second position under the bias of said spring means.

9. The truss clamp of claim 2 further including a releasable lock mechanism to lock said rotatable member in said second position.

10. The truss clamp of claim 2 further including stop means on said rotatable member which cooperates with said fixed member to limit rotation of said rotatable member in said second position under the bias of said spring means.

11. The truss clamp of claim 1 further including a releasable lock mechanism to lock said rotatable member in said second position.

12. The truss clamp of claim 11 wherein said rotatable member is configured to maintain said lock mechanism in an out of lock position when said rotatable member is in said first position and to automatically release said lock mechanism when said rotatable member moves to said second position.

13. The truss clamp of claim 12 further including stop means on said rotatable member which cooperates with said fixed member to limit rotation of said rotatable member in said second position under the bias of said spring means.

14. The truss clamp of claim 11 further including stop means on said rotatable member which cooperates with said fixed member to limit rotation of said rotatable member in said second position under the bias of said spring means.

15. The truss clamp of claim 1 further including stop means on said rotatable member which cooperates with said fixed member to limit rotation of said rotatable member in said second position under the bias of said spring means.

16. The truss clamp of claim 1 further including a releasable lock mechanism to lock said rotatable member in said second position.

17. The truss clamp of claim 1 further including stop means on said rotatable member which cooperates with said fixed member to limit rotation of said rotatable member in said second position under the bias of said spring means.

18. A truss clamp assembly comprising a first clamp and a second clamp, said first and second clamps each having bar means adjustably connected whereby spacing between the clamps may be selectively adjusted, said first clamp having releasable clamp means adapted to be clamped to a fixed truss;

said second clamp having a fixed member and a rotatable member, said rotatable member having first and second ends, said rotatable member being pivotally connected to said fixed member intermediate the ends of said rotatable member and being rotatable between a first position wherein the first end is in confronting relation with a portion of said fixed member and a second position wherein the second end is in confronting relation with said portion of said fixed member;

means for selectively maintaining said rotatable member in said first position and said second position, said maintaining means comprising spring means configured in relation to said pivotal connection to provide an over center action to selectively maintain said member in said first position or second position;

an auxiliary clamp for adjustable connection with one of said bar means and adapted to be temporarily connected to a truss intermediate trusses to which said first and second clamps are associated in use of the clamp assembly.

19. The truss clamp of claim 18 further including a releasable lock mechanism to lock said rotatable member in said second position.

20. The truss clamp of claim 19 wherein said rotatable member is configured to maintain said lock mechanism in an out of lock position when said rotatable member is in said first position and to automatically release said lock mechanism when said rotatable member moves to said second position.

21. The truss clamp of claim 20 further including stop means on said rotatable member which cooperates with said fixed member to limit rotation of said rotatable member in said second position under the bias of said spring means.

22. The truss clamp of claim 19 further including stop means on said rotatable member which cooperates with said fixed member to limit rotation of said rotatable member in said second position under the bias of said spring means.

23. A method of installing a second truss in constructing a roof structure, wherein at least one first truss is already secured in place, each truss having a base and peak roof portion, the method including the steps of:

providing a truss clamp comprising a first clamp, a second clamp, and means adjustably connecting said clamps in spaced relation, the spacing between said clamps being selected in accordance with desired spacing between said trusses when installed, said second clamp including a trip clamp mechanism;

detachably connecting the first clamp to a part of the peak roof portion of said secured first truss such that said second clamp extends in a direction where said second truss is to be located;

locating the base of said second truss generally parallel with the base of the first secured truss and moving the peak roof portion of the second truss into a position whereby the second truss peak roof portion engages with and trips the trip clamp mechanism of said second clamp so that the peak roof portion of the second truss is releasably held in position by said second clamp; and permanently securing the second truss in place by other means and removing the truss clamp for selected reuse.

24. The method of claim 23 wherein there is a further fixed truss immediately adjacent said first fixed truss, said method further comprising:

providing a further auxiliary clamp means;

connecting said auxiliary clamp means to said means connecting said first clamp and second clamp and at a location adjacent said further fixed truss after said first clamp is connected to said first secured truss; and detachably connecting the auxiliary clamp means to said further truss.

25. The method of claim 23 wherein the trip clamp mechanism comprises a fixed clamp portion and a rotatable clamp portion, whereby the rotatable clamp portion is maintained in a first position in a path of movement of said second truss and is caused to be rotated to a second position by further movement of said second truss and retained in said second position to releasably hold said second truss.

26. The method of claim 23 wherein the trip clamp mechanism comprises a fixed clamp portion and a rotatable clamp portion, whereby the rotatable clamp portion is maintained in a first position in a path of movement of said second truss and is caused to be rotated to a second position by further movement of said second truss and retained in said second position to releasably hold said second truss.

* * * * *